United States Patent [19]

Bolt et al.

[11] Patent Number: 4,881,555

[45] Date of Patent: Nov. 21, 1989

[54] SMOKING ARTICLES

[75] Inventors: Anthony J. N. Bolt; John S. Sadd, both of Bristol, England

[73] Assignee: Imperial Tobacco Limited, Bristol, England

[21] Appl. No.: 245,646

[22] Filed: Sep. 16, 1988

[30] Foreign Application Priority Data

Sep. 22, 1987 [GB] United Kingdom ..... 8722309

[51] Int. Cl.[4] ..... A24D 1/00; A24D 1/04

[52] U.S. Cl. ..... 131/335; 131/361

[58] Field of Search ..... 131/337, 335, 336, 361, 131/362, 363, 365

[56] References Cited

FOREIGN PATENT DOCUMENTS 2253822 5/1974 Denmark ..... 131/337

*Primary Examiner*—V. Millin

*Attorney, Agent, or Firm*—Larson and Taylor

[57] ABSTRACT

There is provided a cigarette 10 having a tobacco rod 12 and a filter plug 14. Between the rod 12 and the plug 14 is disposed a porous element 16 containing an aroma precursor which, when the cigarette smoulders down to the butt, is burnt by the coal to release an agreeable aroma into the atmosphere.

12 Claims, 2 Drawing Sheets

SMOKING ARTICLES

Figure 1:
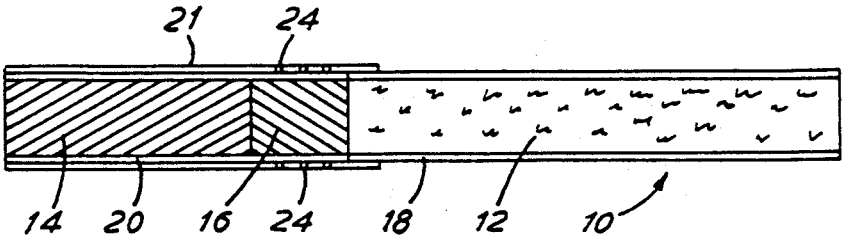

This invention is concerned with improved smoking articles such as filter cigarettes and the like which in appearance and smoking properties closely resemble conventional smoking articles but which are adapted to release into the environment desirable aromas or fragrances other than those which are derived from the combustion of tobacco.

Smoking articles such as cigarettes are designed to generate acceptable tobacco smoke flavour for the smoker as the article is smoked. The odour of fresh ambient tobacco smoke is acceptable to many people, whether smokers or non-smokers, particularly the odour which emanates from smoking articles containing good quality tobacco blends. Smoking articles such as pipes containing aromatic pipe tobaccos and blended cigarettes to which casing materials and top flavous have been applied to enhance smoke taste may also give rise to ambient smoke odours which are acceptable to persons other than the smoker. However, this cannot be said of the odour of stale tobacco smoke, which is considered unattractive by many people.

It is known in the art to add compounds or mixtures of compounds to smoking articles with the aim of agreebly modifying ambient smoke odour during the smoking of the article. However, relatively high levels of such additives are normally required and this is not without perceivable affect on mainstream smoke flavour. For example, U.S. Pat. No. 4,627,449 (International Flavors & Fragrances Inc.) describes a method for enhancing the aroma in the environment of smoking articles which involves addition to the smoking articles of a mixture of certain aldehydes so as to modify and mask the smoky, phenolic, and cresolic odour of the sidestream smoke and impart clean and slightly citrusy character. It is evident, however, that such character will also be imparted to the mainstream smoke flavour, and this may not always be attractive to the smoker.

Unfortunately, it is often the case that those perfumes and fragrances which could be added to the smoking article and which would appear to be appropriate for the enhancement of tobacco smoke odour are not those which are considered to be compatible with tobacco smoke flavour. This disadvantage has been overcome in the past by separately aromatising enclosed spaces in which tobacco articles are used with odorising devices such as perfumed sprays, perfumed combustible materials such as perfumed candles and incenses, or with perfumed ashtray inserts. However, such devices are not always available or convenient to use, or when they are so available, they may not be under the control of the smoker.

It is an object of the present invention to overcome the above disadvantages of smoking articles and hitherto known odorisers by providing a cigarette, cigar or similar smoking article containing tobacco leaf, reconstituted tobacco or tobacco substitutes with integral means for the release into the atmosphere of selected aromas or fragrances, whilst retaining the general appearance and smoke flavour properties of a conventional smoking article.

According to the present invention there is provided a smoking article having a rod of smoking material and a heat-sensitive fragrance or aroma release element that is adapted to release a volatile fragrance or aroma into the ambient atmosphere when the burning coal of the smoking material reaches the vicinity of the element characterised in that the volatile fragrance or aroma is released only after the whole or substantially the whole of the rod of smoking material has been combusted.

The aroma release element is preferably combustible and adapted to smoulder under the influence of heat from the burning coal of smoking material in its vicinity.

The smoking article may be a filter cigarette and the aroma release element is preferably located between the filter and the rod of smoking material, in which case a tipping paper extends upstream of the filter to cover the aroma release element.

The smoking material may be tobacco leaf, reconstituted tobacco or tobacco substitutes, or any combination thereof.

The aroma release element is preferably cylindrical in shape and is porous to allow the passage of smoke from the rod of smoking material into the smoker's mouth. The resistance-to-draw or pressure drop presented by the element is preferably either zero or very low compared with the resistance-to-draw of conventional cigarettes or the like. The element may indeed act as a filter and retain smoke components derived from the rod of smoking material but is it preferred that filtration by the element is minimised so that aroma or fragrance release on smouldering is not substantially influenced by components of tobacco smoke.

The invention will now be described by way of example only with reference to the accompanying diagrammatic drawings in which, FIG. 1 is a longitudinal section through a filter cigarette according to the invention, including a cylindrical element 16.

Figure 2:
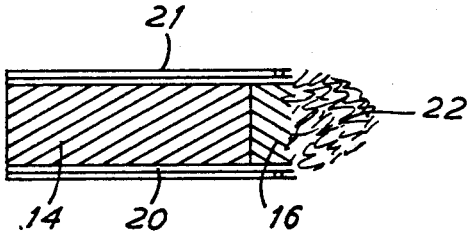

FIG. 2 is a longitudinal section through the cigarette of FIG. 1 when partly combusted.

FIGS. 3 to 8 are lateral sections through different embodiments of the element 16 in FIGS. 1 and 2, and FIGS. 9 and 10 are longitudinal sections through filter cigarettes incorporating further embodiments of the present invention.

Referring to FIG. 1 there is shown a filter plug cigarette 10 made according to the invention comprising a tobacco rod 12, a filter plug 14, and between the rod and the filter plug a porous combustible cylindrical element 16 containing an aroma precursor that is volatilisable by the heat of combustion of the cylindrical element to release an agreeable aroma or fragrance into the atmosphere.

The tobacco rod 12 is wrapped in cigarette paper 18, and the filter plug 14 is wrapped in porous plugwrap 20 which also wraps the element 16. Tipping paper 21 enwraps the plugwrapped filter plug 14 and the element 16 and overlaps the cigarette paper wrapped tobacco rod 12 so as to secure the tobacco rod to the filter plug and the element. The tipping paper 21 is provided with perforations 24 or a region of porosity in the section overlying the element 16.

FIG. 2 shows the cigarette 10 of FIG. 1 when allowed to smoulder down to the butt. The smouldering coal 22 of the tobacco rod burns into the element 16 which likewise smoulders and causes the odorant trapped therein to volatilise into the atmosphere.

Figure 3:
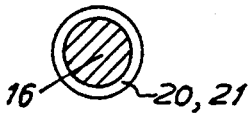

FIG. 3 shows a randomly porous element 16, wherein the interstices within the element are randomly disposed as are the interstices between the fibres in a tobacco rod.

Figure 4:
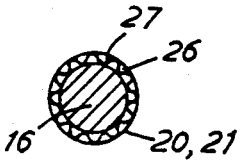

FIG. 4 shows an element 16 provided with open-ended peripheral smoke channels 26 parallel to its axis. Such channels may be provided by a web of duplex paper 27.

Figure 5:
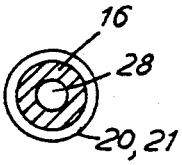
Figure 6:
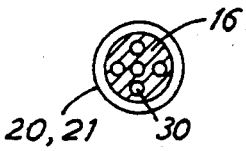

FIGS. 5 and 6 show elements 16 which are extruded or moulded monoliths provided with a single axial channel 28 (FIG. 5) or a plurality of axially parallel channels 30 (FIG. 6).

Figure 7:
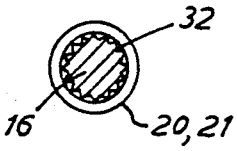

FIG. 7 shows an element 16 that is also an extruded or moulded monolith the peripheral surface of which has been provided with smoke channels 32.

Each of the elements 16 shown in FIGS. 3 to 7 is provided with plugwrap and tipping paper 20, 21 both of which are combusted with the element. The wrapping paper and that region of the tipping paper which covers the element may optionally be treated with known burn promoters.

Figure 8:
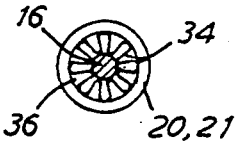

FIG. 8 shows an element which may be manufactured by any of the aforementioned or other means which is characterised by its diameter being a substantially smaller proportion of the total cigarette diameter than in the preceding examples. In FIG. 8 the combustible element 16 is shown being held axially by a corrugated duplex web 34 between the element and the plugwrap and tipping paper 20, 21 to provide longitudinal smoke channels 36. The web 34 and optionally the wrapping and tipping paper 20, 21 may be treated with known burn retardants such that only the element smoulders, leaving the web and the wrapping and tipping papers substantially intact.

In use, the filter cigarette 10 is smoked in the normal fashion and is then allowed to complete its smoulder either being hand-held or after placing in an ashtray or similar receptacle. The aroma-containing element 16 is automatically ignited by the advancing coal 22 of the smouldering cigarette whereupon the element 16 in turn smoulders and releases a fragrance or aroma into the atmosphere. The element 16 commences to smoulder when all or substantially all tobacco contained in the cigarette 10 has been combusted. Thus there will be no burning tobacco left which might otherwise remain to impart an interfering odour. By delaying the smoulder of element 16 until all the tobacco has been consumed, contamination of the smoke is avoided and is not passed to the smoker during smoking. A proportion of the aroma released from the smouldering element 16 penetrates and is slowly released from the filter. In this way environmental odour and the odour of smoking product butts and ashtrays is improved.

The smoulder period of the element depends on the weight of combustible material it contains and also on the latter's chemical and physical nature. The element may be formed by moulding or extruding a cylindrical monolith which is either randomly porous or which incorporates one or more discrete channels through which smoke may pass. Alternatively, it may be constructed of fibrous or particulate material in a manner similar to that in which cigarettes are manufactured or it may be fabricated from a continuous dry- or wet-laid tow or web in a manner resembling conventional cigarette filter manufacture. In each case, resistance to draw may be reduced or eliminated by incorporating one or more combustible tubes into the element or by supplying it with peripheral channels during its manufacture. Yet other methods may be devised for manufacturing the element.

The element includes, in addition to an odorant for releasing the volatile aroma, fuels such as wood powder, powdered tobacco stem, cellulose, regenerated cellulose, cellulose derivatives and carbon, fillers such as chalk and alumina, burn modifying agents such as potassium nitrate and magnesium carbonate and binding agents such as mucilage and sodium carboxy methyl cellulose. Indeed any material known to manufacturers of incense cones and sticks, pastilles, papers, fumigants and similar products may be included.

Volatile aromas from a large range of natural, nature-identical or synthetic (i.e. not naturally occurring) substances may be used and include olibanum, benzoin, myrrh, labdanum, Peruvian balsam, sandal, styrax, vetiver, patchouli, chypre, cedarwood, clove and cinnamon, and similar incense-type products, fruity and floral fragrances such as lemon, orange, peach, blackberry, vanilla, jasmine, rose and lavender, and other fragrances such as peppermint, eucalyptus, musk or fantasy fragrances. Fragrances such as citronella which also have an insect repellant role may also be included.

A particular advantage of the present invention is that the release of aroma incorporated in the heat-sensitive element is substantially delayed until the product is smoked and in particular until after the tobacco section has been consumed. This is achieved by stabilising the volatile ordorants by one or more of several available techniques such as physical entrapment, encapsulation, inclusion complex formation or where appropriate chemical bonding in non-volatile precursors. The entrapment of aromas in inclusion complexes with cyclodextrins is particularly valuable in this respect.

Smoking articles of the present invention incorporating relatively short aroma release elements closely resemble in appearance conventional smoking articles. Relatively longer elements are particularly suited to extra long cigarette designs or designs having short slow-burning tobacco sections since they allow cigarette lengths either to be maintained or increased without concomitant increase in butt lengths. Mainstream smoke vapour phase yields may be reduced in these designs by incorporating combustible elements with peripheral channels in combination with porous wrapping and/or tipping papers, as is well known in the art of cigarette manufacture.

Figure 9:
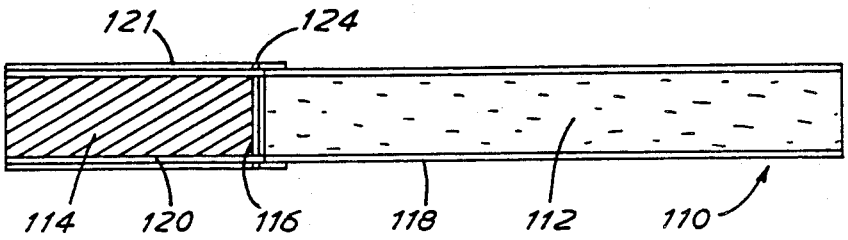

In FIG. 9 there is shown an alternative embodiment of a filter cigarette 110 made according to the present invention. In this embodiment the element 16 of FIG. 1 is replaced by an element 116 comprising two discs of highly porous filter paper, each 16 mm in diameter crimped together around their periphery and trapping between them an aroma releasing powder. In all other respects the filter cigarette is similar in construction to that of FIG. 1.

The element 116 is disposed between the filter plug 114 and the tobacco rod 112 touching both in face to face contact. The tipping paper 121 extends beyond the location of element 116 and over the cigarette paper 118.

The powder within element 116 can be of any appropriate aroma releasing nature arranged to release the aroma when smoulder is initiated by the proximity of the burning coal of the cigarette as the last of the tobacco rod is combusted.

EXAMPLE 1

An inclusion complex was prepared from $\beta$-cyclodextrin and lavender oil as follows. 50 g of $\beta$-cyclodextrin was dissolved in 2 litres of water at 50° C. After cooling, the solution was filtered through a 5 $\mu$ micropore film. To 200 ml of this solution, 0.77 g of lavender oil was added and the mixture stirred vigorously at 20° C. for 2 h. The precipitate which formed was collected by suction filtration and washed with absolute ethanol and dry, distilled diethyl ether to give 4.0 g of a white, odourless powder.

An odour release element 116 was then formed by trapping 5mg of the above powder between two circular discs of higly porous lightweight paper, each 6 mm in diameter, by crimping at the circumference.

The odour release element 116 was incorporated in a handmade cigarette between the filter and the tobacco rod, ensuring that the tipping paper extended beyond the location of the odour release element. On smoking the cigarette to the tipping paper, and then allowing it to continue to smoulder in an ashtray, a pleasing aroma of lavender was released before the cigarette went out.

EXAMPLE 2

An odourant material similar to that used in the construction of incence sticks and cones was prepared by mixing 95 parts of fine sawdust and 5 parts of lemon oil with sufficinet quantity of a 2% solution of sodium carboxy methyl cellulose to bind the components, allowing this mixture to dry at room temperature and grinding it to a powder.

An odour release element 116 was constructed by trapping 10 mg of the above powder between two circular discs of highly porous lightweight paper, each 6 mm in diameter, by crimping them at the circumferences.

The odour release element 116 was incorporated in a handmade cigarette between the filter and the tobacco rod, ensuring that the tipping paper extended just beyond the location of the odour release element. On smoking the cigarette to the tipping paper, and then allowing it to continue to smoulder, a pleasant lemon aroma was produced.

Figure 10:
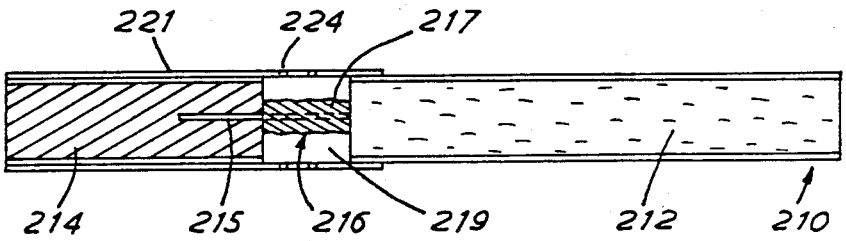

Referring to FIG. 10 there is shown a filter cigarette 210 made in accordance with a further embodiment of the present invention. The cigarette is similar to those described with reference to FIGS. 1 and 9 but in this embodiment the aroma release element 216 is formed by a miniature incense stick in which the stick 215 is embedded in the upstream end face of the filter plug 214 with the active ingredients 217 on the protruding end of the stick disposed within a chamber 219 defined between the filter plug 214 and the tobacco rod 212. The tip of the incence stick touches the end face of the tobacco rod 212 such that the burning coal of the consumed rod will ignite the incense stick and cause it to smoulder.

EXAMPLE 3

The miniature incense stick was produced from a commercially available incense stick composed mainly of wood powder, rose oil and diethylphthalate. It was cut and trimmed to reduce it to a miniature version of the full size stick, 14 mm long with a 6 mm stem and 8 mm covered in the mixture.

The miniature incense stick was located in a hand made cigarette as described above. The tipping paper 221 was extended beyond the chamber 219 and over the end of the tobacco rod 212.

In use, the tobacco rod 212 was consumed. As the hot coal reached the tipping paper, with virtually the whole of the rod consumed, the hot coal ignited the tip of the incense stick causing it to smoulder. As the last of the tobacco finished burning, the incense stick continued to smoulder, giving off a pleasant odour of rose.

With the three examples described with reference to FIGS. 9 and 10 a pleasant aroma is released after the whole or substantially the whole tabacco rod has been consumed, but not before. Thus the smoker's pleasure is not affected by the aroma and the pleasant odour is released at the moment the unpleasant 'after' smells are produced.

We claim:

1. A smoking article comprising a rod of smoking material, a heat sensitive aroma-release element disposed adjacent an end of the smoking material, said heat sensitive aroma release element releasing the aroma into the ambient atmosphere when the burning smoking material reaches the vicinity of the element so that the aroma is relased only after substantially all the smoking material is combusted, said heat sensitive aroma release element being combustible and adapted to smoulder under the influence of heat from the burning smoking material.

2. A smoking article as claimed in claim 1 and further including a filter, the aroma release element being located between the filter and the rod of smoking material, a tipping paper extending from the filter to the rod and covering the aroma release element.

3. A smoking article as claimed in claim 2 in that the element is provided by a mixture of an odourant and a fuel disposed in a void between the filter plug and the rod of smoking material.

4. A smoking article as claimed in claim 1 characterised in that the smoking material is tobacco leaf, reconstituted tobacco or tobacco substitutes, or any combination thereof.

5. A smoking article as claimed in claim 4 characterised in that the aroma release element is porous to allow the passage of smoke from the rod of smoking material into the smoker's mouth.

6. A smoking article as claimed in claim 1 characterised in that the resistance-to-draw or pressure drop presented by the element is either zero or very low compared with the resistance-to-draw of conventional cigarettes.

7. A smoking article as claimed in claim 6 characterised in that the article incorporates one or more discrete channels to permit passage of smoke past and/or through the element.

8. A smoking article as claimed in claim 6 in that the element is provided by highly porous paper enclosing the odourant.

9. A smoking article as claimed in claim 1 characterised in that the element acts as a filter and retains smoke components derived from the rod of smoking material.

10. A smoking article as claimed in claim 1 characterised in that the element includes an odourant for releasing a volatile aroma and a fuel for assisting smoulder.

11. A smoking article as claimed in claim 10 characterised in that the element includes a burn modifying agent.

12. A smoking article as claimed in claim 10 characterised in that the element includes a filler and a binding agent.

* * * * *